US005397394A

United States Patent [19]

Orr

[11] Patent Number: 5,397,394

[45] Date of Patent: Mar. 14, 1995

[54] POWDER COATING BOOTH

[75] Inventor: Jerome D. Orr, Birmingham, Ala.

[73] Assignees: The Fishing Group, Ormond Beach, Fla.; The Andersons, Maumee, Ohio

[21] Appl. No.: 119,330

[22] Filed: Sep. 9, 1993

[51] Int. Cl.[6] ..... B05B 5/025

[52] U.S. Cl. ..... 118/634; 118/312; 118/326; 118/DIG. 7; 454/52

[58] Field of Search ..... 118/624, 634, 309, 326, 118/312, DIG. 7, 324; 454/50-54

[56] References Cited

U.S. PATENT DOCUMENTS

| | | | |
|---|---|---|---|
| 4,245,551 | 1/1981 | Berkmann | 55/356 |
| 4,409,009 | 10/1983 | Lissy | 55/302 |
| 4,498,913 | 2/1985 | Tank et al. | 55/356 |
| 4,537,120 | 8/1985 | Josefsson | 454/52 |
| 4,590,884 | 5/1986 | Kreeger et al. | 118/308 |
| 4,662,309 | 5/1987 | Mulder | 118/312 |
| 4,664,061 | 5/1987 | Morioka et al. | 118/DIG. 7 |
| 4,704,953 | 11/1987 | Wilson | 118/326 |
| 4,723,505 | 2/1988 | Wilson et al. | 118/326 |
| 4,910,047 | 3/1990 | Barnett et al. | 427/195 |
| 4,926,746 | 5/1990 | Smith | 454/52 |
| 4,951,600 | 8/1990 | Soshi et al. | 118/326 |
| 5,133,246 | 7/1992 | Campbell | 454/53 |
| 5,153,028 | 10/1992 | Shutic et al. | 118/326 |
| 5,153,034 | 10/1992 | Telchuk et al. | 118/326 |
| 5,162,132 | 11/1992 | Diaz | 118/326 |
| 5,173,118 | 12/1992 | Josefsson | 118/326 |
| 5,277,652 | 1/1994 | Minor | 454/52 |

*Primary Examiner*—James C. Housel
*Assistant Examiner*—Rachel Heather Freed
*Attorney, Agent, or Firm*—Gifford, Krass, Groh, Sprinkle, Patmore, Anderson & Citkowski

[57] ABSTRACT

A powder coating booth and a recirculating air system is provided for electrostatic coating of articles. The booth includes an operator compartment and a spray chamber. A recirculating fan supplies air to the operator compartment which passes through a window into the spray chamber. The fan also provides air flow through orifice plates at the top of the spray chamber to surround the articles in a controlled manner. The fan additionally supplies air against the back wall of the spray chamber. All of the air in the spray chamber is passed through a reclamation filter and back to the fan. The entire system can be provided on a mobile base.

16 Claims, 5 Drawing Sheets

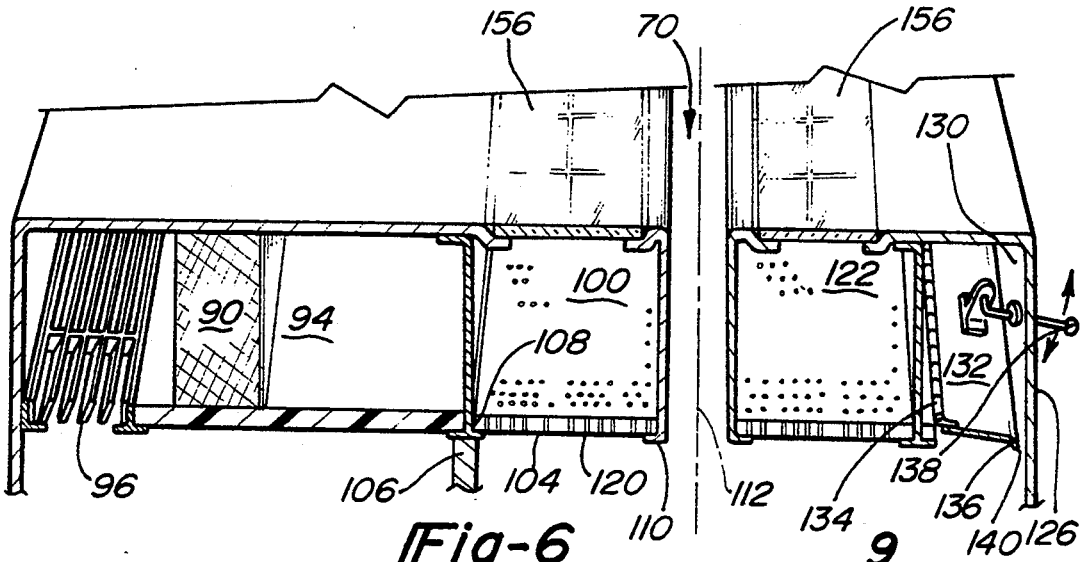
Fig-6
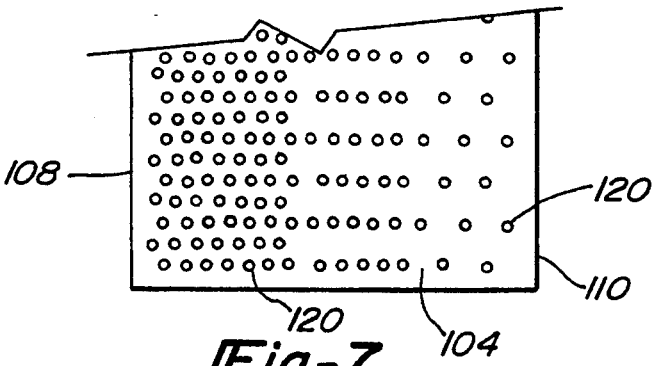
Fig-7
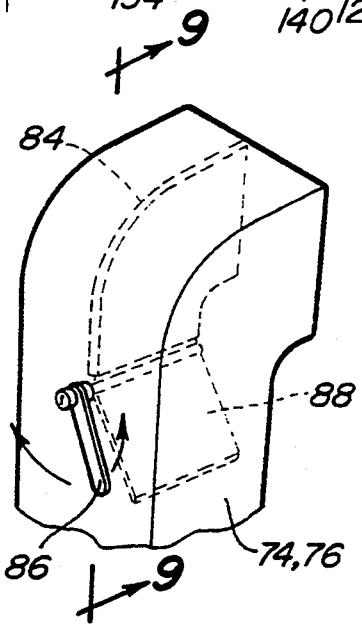
Fig-8
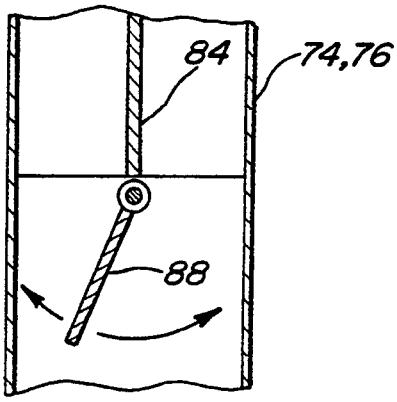
Fig-9
Fig-10
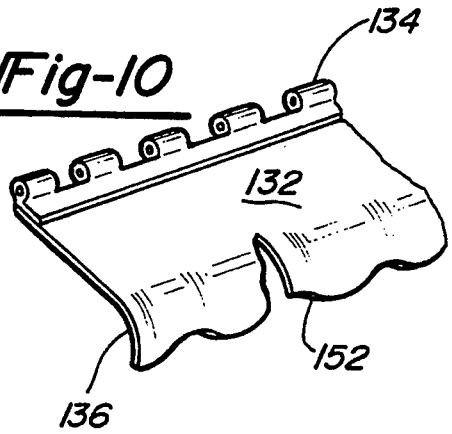

POWDER COATING BOOTH

BACKGROUND OF THE INVENTION

1. Field of the Invention

This invention relates to powder coating systems. More particularly this invention relates to a powder coating booth in which air is recirculated in a controlled fashion to enhance transfer efficiency to the articles being coated, to improve over spray coating particle recovery and to protect the spray gun operator from coating particles.

2. State of the Art

In wet paint spray booths, water curtains are often used to entrap over spray paint particles with no attempt being made to recover the paint particles. With powder coating systems, the expense of the paint coating particles requires recovery of as much as possible of the overspray particles, that is, the particles not adhering to the product being coated.

Typically in powder coating systems, the operator introduces his electrostatic spray gun through an open window in the spray booth to spray the coating particles against the articles being coated. Air is drawn into the booth through the window by an exhaust fan to entrain the overspray particles. The particle laden air is drawn out of the bottom of the booth and passed through a filter to remove the coating particles with the clean air being exhausted back to the shop environment from which the air was drawn.

When articles being sprayed are conveyed through the powder coating booth, air will also be drawn into the end wall openings through which the articles being coated pass. Also some air will pass into the booth through the conveyer opening in the top of the booth.

In these prior art structures, there is no attempt made to direct the air in a particular manner past the articles being sprayed so as to optimize transfer efficiency and particle recovery. Also there is no attempt made to isolate the spray gun operator to eliminate or minimize back spray to the operator and on his clothing.

While conventional open air flow systems have been built with at least some portions being mobile such as the filter unit to accomodate changing the color being sprayed, there have been no recirculating air systems and hence no completely mobile recirculating systems in which the powder spray booth, the fan, filter and all connecting ducts are self-contained on a mobile platform for alignment with an overhead article conveyor.

SUMMARY OF THE INVENTION

The present invention provides a powder coating booth in which electrically charged coating particles are sprayed onto articles being conveyed through the booth. A longitudinally extending spray chamber has front, back, top and bottom walls and ends through which the articles to be sprayed with coating particles are passed along a work path between the front and back walls. A recirculating air blower passes air downwardly through orifices in the top wall on both sides of the work path. Additional air is supplied downwardly through a longitudinally extending slot nozzle in the top wall to sweep against the back wall. An operator compartment has a common front wall with the spray chamber and also has back, top, bottom and end walls. The front wall has a window opening through which the operator sprays coating particles onto the articles passing along the work path. The recirculating air blower passes operator air through louvers in the top wall adjacent the back wall of the operator compartment so that the operator air sweeps downwardly pass the operator into the spray chamber through the window opening. An extraction hopper is located in the bottom wall of the spray chamber for collecting air passing through the top wall of the spray chamber and through the window opening along with coating particles that have not adhered to the articles being sprayed. A cartridge filter receives the air from the extraction hopper and removes the coating particles to produce clean air. A duct passes the clean air from the cartridge filter to the recirculating air blower. Preferably an additional high efficiency filter is located between the recirculating fan and the louvers to further filter the air that passes through the operator compartment.

Front and rear top air plenums are located on the front and rear sides of the work path, and the orifices are located in downwardly facing orifice plates of each top plenum. The orifices are sized and spaced in the front orifice plate to cause an increasing air flow from adjacent the work path toward the front wall on the front side of the work path and in the rear orifice plate to cause increasing air flow from adjacent the work path toward the rear wall on the rear side of the work path. This produces a quiescent air envelope around the work maximizing transfer of coating particles to the articles being coated and also produces a flow of air with the particles not adhering to the articles in a downward direction toward the extraction hopper. Air passing through the longitudinally extending slot nozzle in the top wall sweeps against the back wall so that no coating particles adhere to the wall but are also conveyed downwardly into the extraction hopper.

In a preferred form of the invention the recirculating air blower is connected to a distribution plenum chamber below the bottom wall of the operator compartment. The distribution chamber is then connected by vertical ducts with the top air plenums and with a duct supplying air through the longitudinally extending slot nozzle and additionally to a duct supplying air through the louvers into the operator compartment. Dampers are contained in the vertical ducts to control the proportion of air being delivered to the operator compartment along with controlling the air being delivered through the front and rear orifice plates and the air being supplied through the slot nozzle along the back wall of the spray chamber.

Additionally an air vent in the distribution plenum allows a controlled portion of the air to escape to atmosphere so that the total air being supplied to the spray chamber will be supplemented by some air passing through the ends of the spray chamber and through the conveyer opening in the top of the spray chamber thus ensuring that there is no outflow of air from the spray chamber except through the extraction chamber located at the bottom of the spray chamber.

The extraction hoppers converge downwardly from the front wall towards a rear wall of the spray chamber to an exhaust duct which is connected to the cartridge filter.

In a preferred embodiment of the invention the operator compartment is of sufficient length to accomodate two operators which spray coating particles at different levels onto the articles passing along the work path. The bottom wall or floor of the operator compartment can be at two different heights assisting the operators in spraying the articles at two different levels. A separate collection hopper and exhaust duct is located in the spray chamber in line with each floor level and operator.

In another preferred embodiment of the invention a second spray chamber is located on the other side or rear of the work path so that an operator can spray paint particles on the rear portion of the articles passing along the work path. In this second spray chamber the extraction hopper will converge downwardly from the rear wall towards the front wall of the chamber to an exhaust duct connected to the cartridge filter. In this way, the exhaust ducts all pass in the same direction toward the cartridge filter.

Preferably the longitudinally extending slot nozzle includes a damper plate which is hinged at one longitudinally extending side to the nozzle air supply duct in the top wall and is curved at its free longitudinally extending side with provision for moving this side toward and away from the back wall to control the width of the slot nozzle. In a preferred form this damper plate curves into a downward extending portion at its free longitudinally extending side and this downwardly extending portion has a longitudinally extending sinusoidally shaped free end. This varying point of discharge eliminates eddies and permits a much quieter operation of the slot nozzle discharge.

The compact arrangement of a common air distribution chamber below the bottom wall of the operator compartment supplying air to a series of damper controlled vertical ducts delivering air to be recirculated downwardly through the operator compartment and spray chamber has permitted the entire system to be mounted on a mobile base so that it can be moved into and out of alignment with an overhead conveyer system, allowing rapid change of colors or articles being coated.

BRIEF DESCRIPTION OF THE DRAWING

A better understanding of the present invention will be had upon reference to the following detailed description when read in conjunction with the accompanying drawing, wherein like reference characters refer to like parts throughout the several views, and in which:

FIG. 6 is a perspective view of the top plenum chambers and air supply ducts above the spray chamber and operator compartment for introducing air into the operator compartment and spray chamber;

FIG. 7 is a partial plan view of the orifice plate for the top plenum chambers;

FIG. 8 is a fragmentary perspective view of the damper arrangement located at the top of one of the vertical air supply ducts;

FIG. 9 is a partial elevational view along line 9—9 of FIG. 8; and

FIG. 10 is a fragmentary perspective view showing a portion of the slot nozzle construction.

DETAILED DESCRIPTION OF THE PRESENTLY PREFERRED EMBODIMENTS

Figure 1:
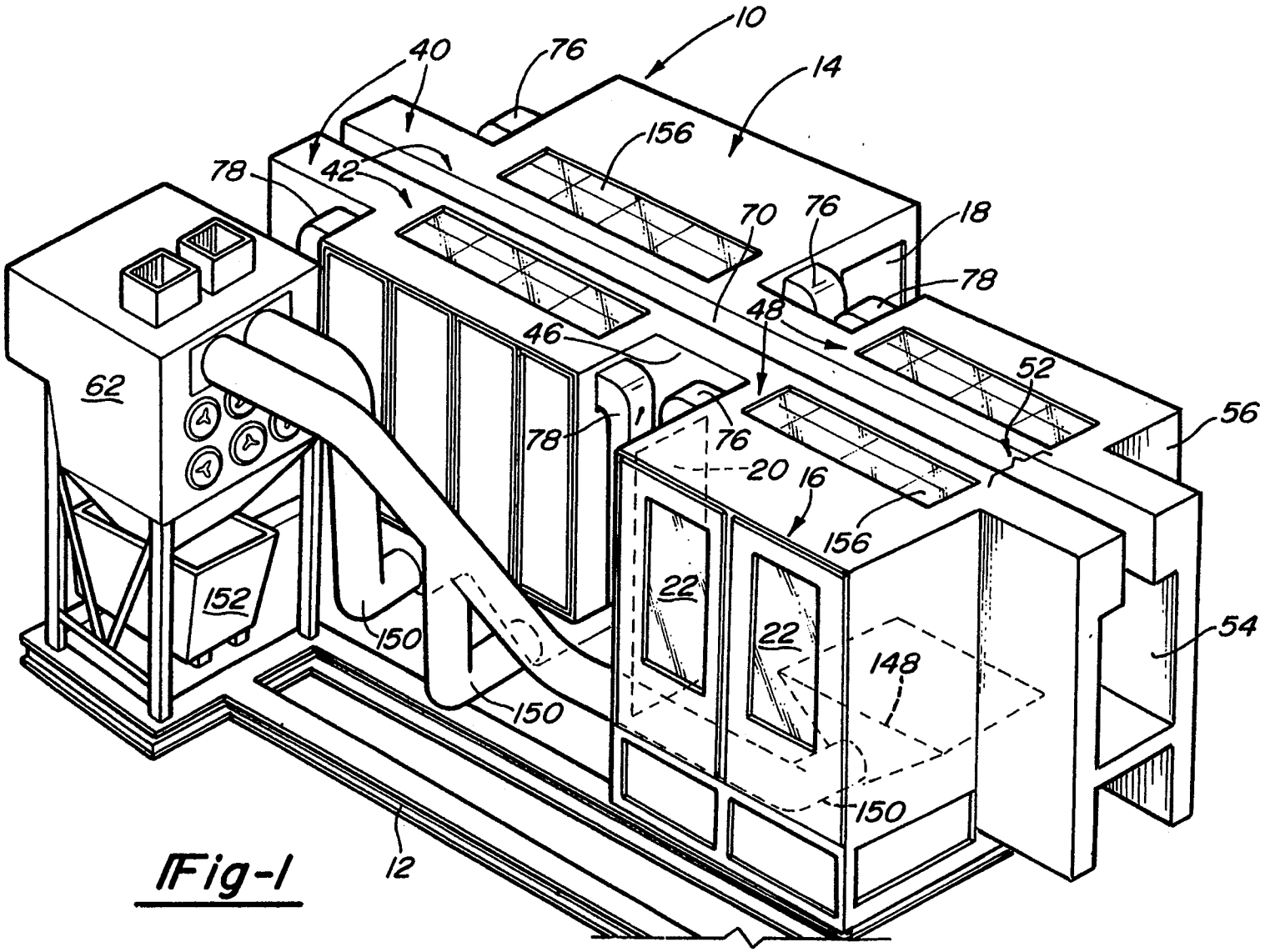
FIG. 1 is a perspective view of the powder coating booth of this invention taken from the rear side showing a one man rear operator compartment in the foreground.
Figure 2:
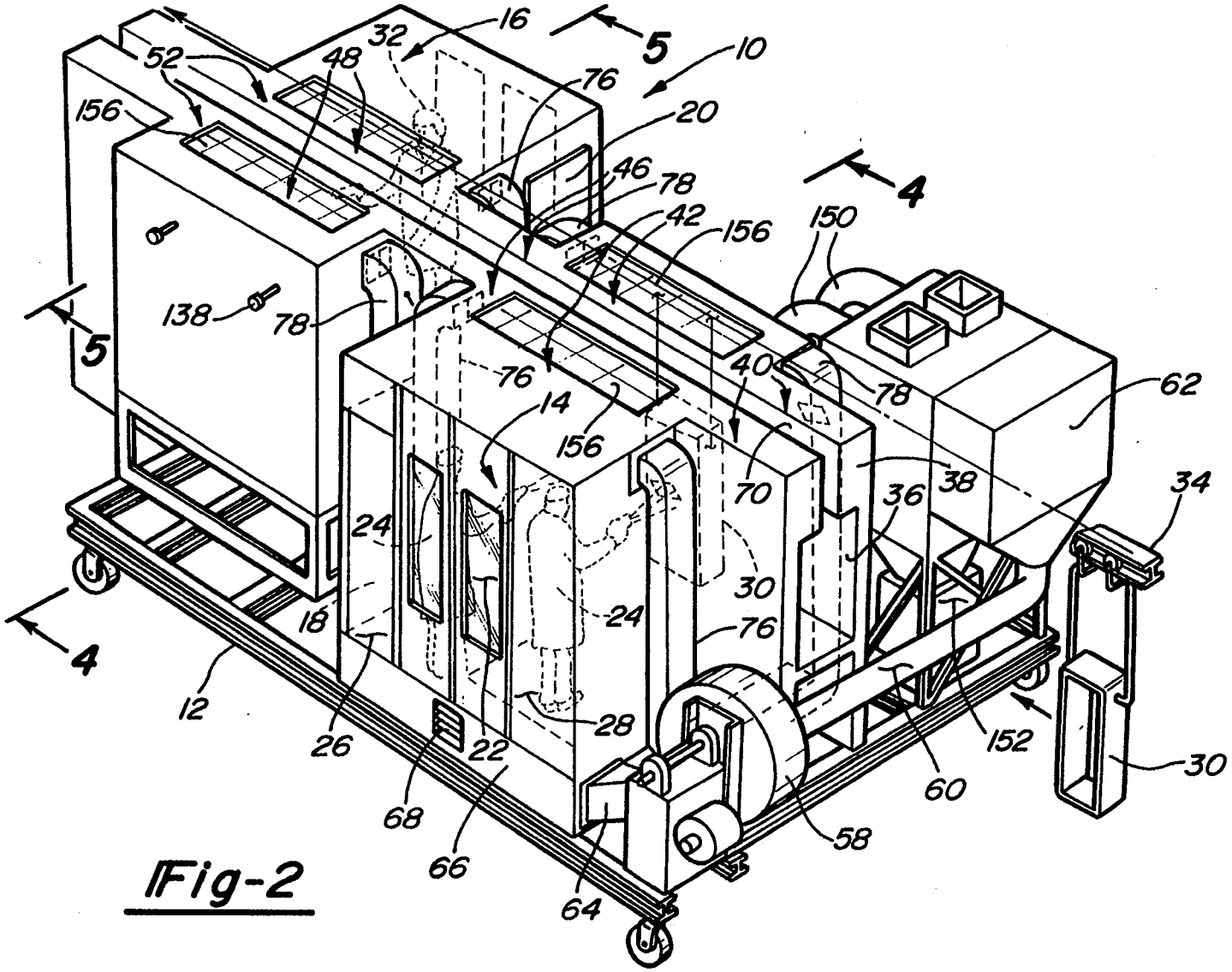
FIG. 2 is a perspective view from the front side of the powder coating booth showing a two man from operator compartment in the foreground, and showing front and rear operator compartments and spray chambers, the entire system with its fan, filter and connecting ducts mounted on a mobile frame for movement into the position shown aligned with an overhead conveyor system moving articles to be coated through the powder coating booth.

Referring to FIGS. 1 and 2, the powder coating booth 10 of the present invention is shown mounted on a mobile frame 12 with all its supporting equipment. The front and rear operator compartments 14 and 16 are completely enclosed, having their respective access doors 18 and 20. Observation windows 22 are provided in each of the compartments. The front operator compartment 14 houses two operators 24 at two different floor levels 26 and 28 to facilitate division of the work. For example, the operator on the higher floor 28 will spray the top portion of the work shown as a cabinet shell 30 so that he will spray the upper half of the insides and approximately one half the width of the exterior of the top and one half the width of the upper half of the side wall exteriors. The operator on the lower floor 26 will spray the bottom portion of the cabinet shell which will include the lower half of the inside and approximately one half of the width of the exterior of the bottom and one half of the width of the lower half of the side wall exteriors. A single operator 32 in rear compartment 16 would spray the exterior surfaces of the back and half the width of the sides and half the width of the bottom and top.

Figure 4:
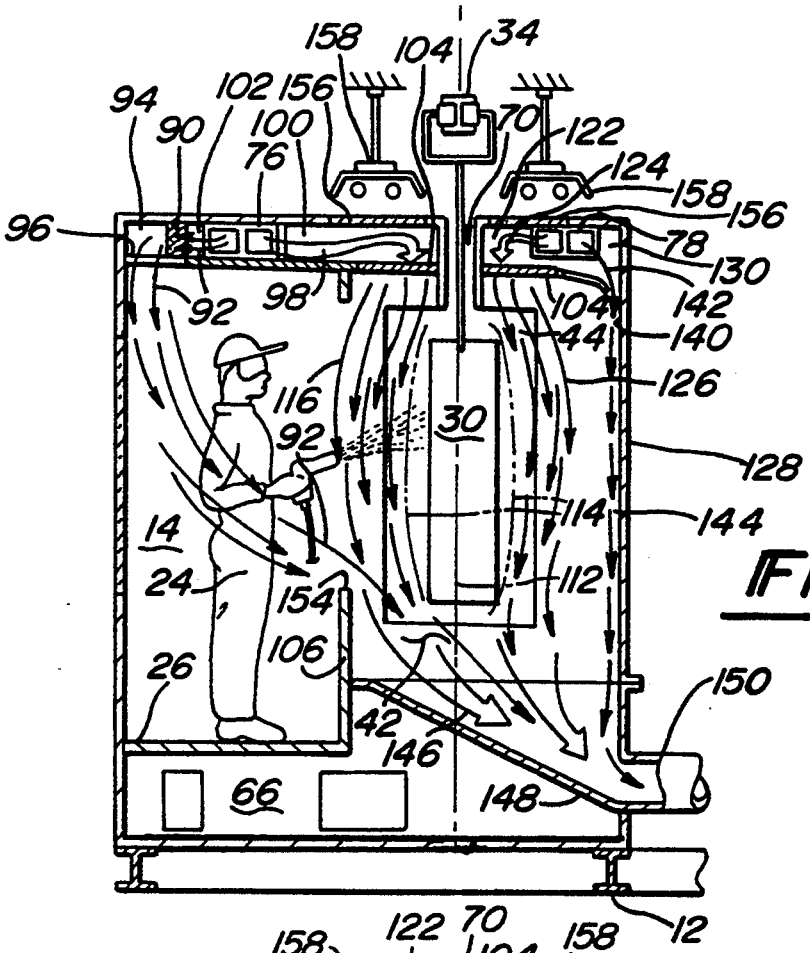
FIG. 4 is an end elevational view partially in section taken along line 4—4 of FIG. 2 showing the front operator compartment and spray booth.
Figure 5:
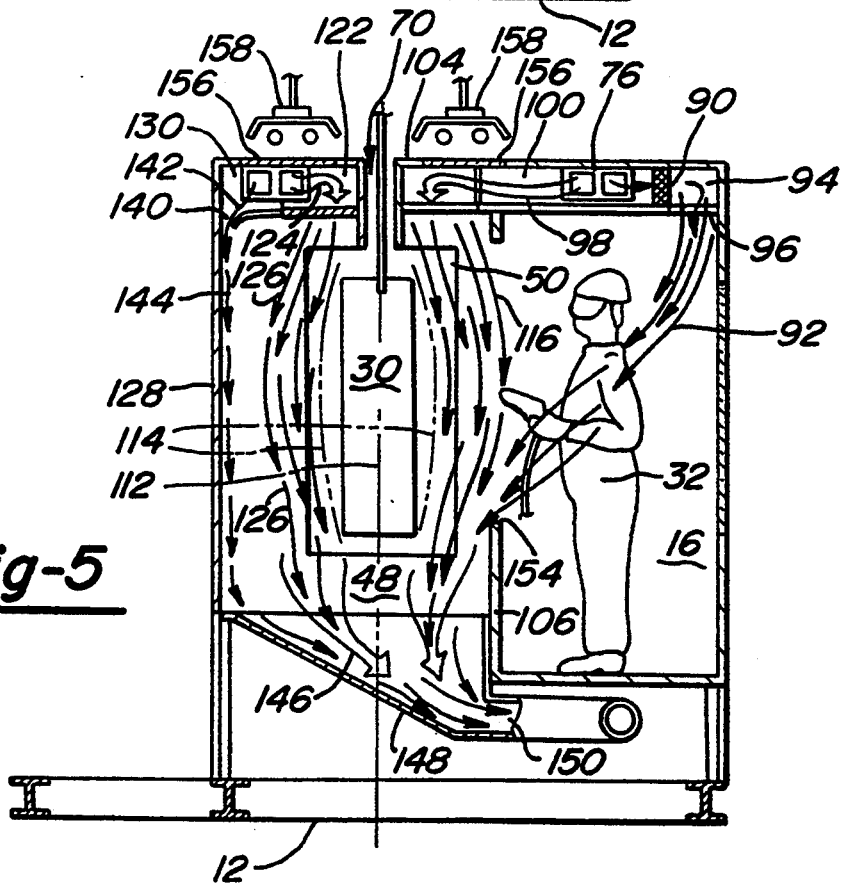
FIG. 5 is an end elevational view partially in section taken along line 5—5 of FIG. 2 showing the rear operator compartment and spray booth.

As seen in FIG. 2 the entire powder coating booth 10 can easily be moved into line with the stationary overhead conveyor 34 to permit movement of the articles 30 to be powder coated through the entrance opening 36 in the end wall 38 of entrance vestibule 40 to and through the front spray chamber 42 as seen in FIG. 4. The articles then pass through an opening 44 into connecting vestibule 46 and into and through rear spray chamber 48 as best seen in FIG. 5. The articles then pass through an opening 50 into exit vestibule 52 and then out opening 54 in end wall 56.

Figure 3:
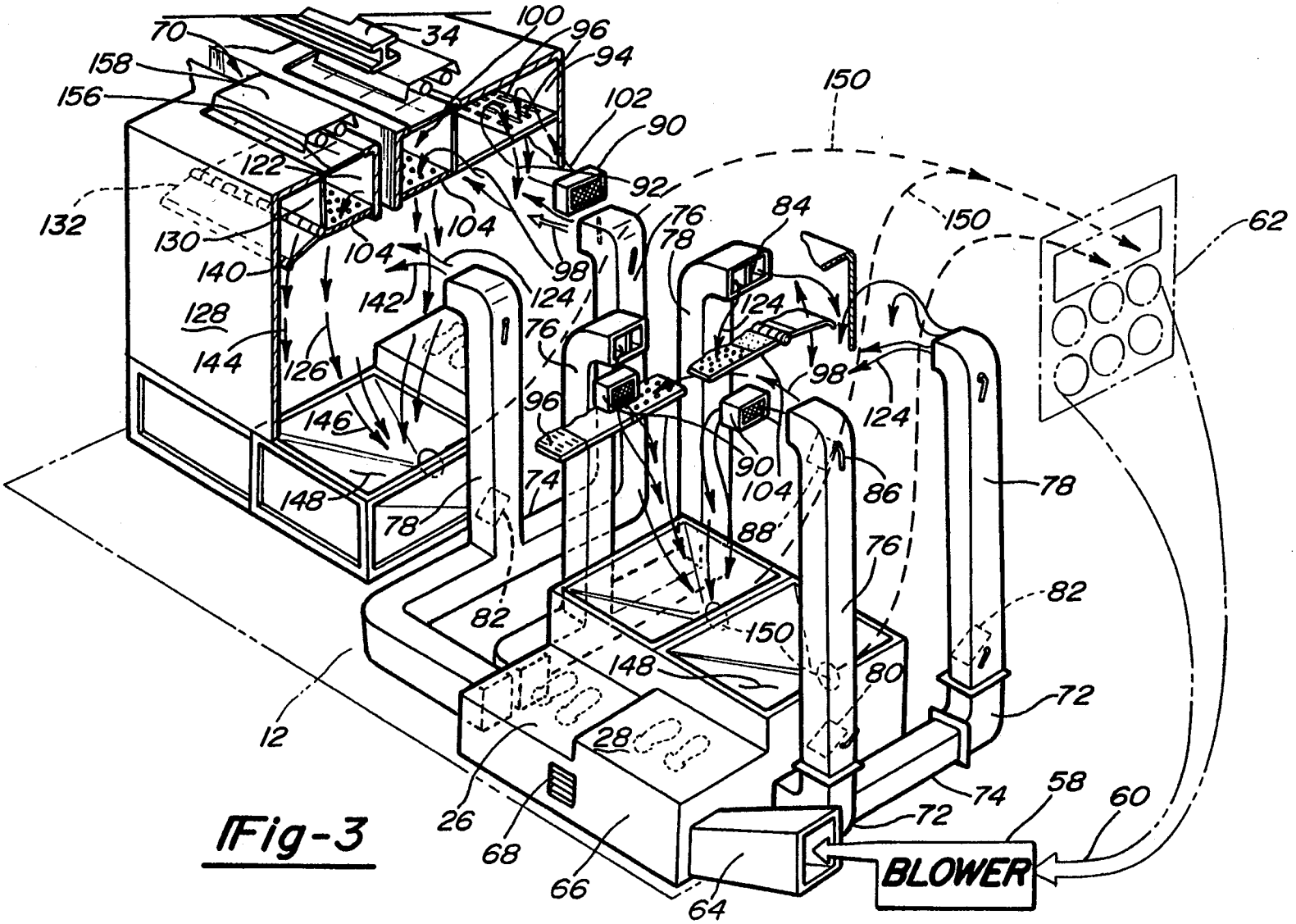
FIG. 3 is a cutaway perspective view of the air recirculating system with air duct connections to the various portions of the powder coating booth.

Referring primarily to FIGS. 2 and 3, recirculating air blower 58 receives all of its intake air through intake duct 60 from the cartridge filter 62. All the air is delivered from the blower 58 through supply duct 64 to air distribution plenum chamber 66 located under the bottom wall 26, 28 of the operator compartment 14. A controlled portion of the air is vented to atmosphere through adjustable louver vent 68 to assure that there will be a small inflow of air through the entrance opening 36, exit opening 54 and the top conveyor opening 70. This prevents any outflow of air at these points. Air is delivered from the distribution chamber 66 through transistion elbows 72 and horizontal ducts 74 to front and rear vertical distribution ducts 76 and 78. Air is proportioned between the front and the rear ducts 76 and 78 by individual dampers 80 and 82 located in the lower portions of these ducts. The air in both the front and rear ducts 76 and 78 is further divided into two portions by divider baffle walls 84 located at the top of these ducts as best seen in FIGS. 8 and 9. The air is proportioned on each side of the baffle wall 84 by rotation of lever 86 to adjust the position of damper 88 attached to the lower end of baffle wall 84.

A portion of the air passing through the from distribution ducts 76 is passed through high efficiency HEPA filter 90 to remove any trace elements of particles not removed by the cartridge filter 62. The air passes, as shown by the arrows 102, from the filter 90 into operator compartment supply duct 94 and through louvers 96 into the from and rear operator compartments 14 and 16 and through windows 154 into front and rear spray chambers 42 and 48 as shown by arrows 92 and as best seen in FIGS. 3–6.

The balance of the air passing through the front distribution ducts 76 enters, as shown by the arrows 98, into forward air plenum chambers 100 of front and rear spray chambers 42 and 48.

As seen in FIGS. 4 and 5, a common front wall 106 separates the from and rear operator compartments 14 and 16 from the front and rear spray booth. 42 and 48. An orifice plate 104 at the bottom of the forward air plenum chamber 100 extends from the wall 106 to adjacent the center 112 of the work path or the center of the articles 30 being sprayed.

As seen in FIGS. 6 and 7, the number or density of equally sized orifices 120 decreases from an outer edge 108 of the orifice plate 104 adjacent the from wall 106 towards an inner edge 110 adjacent the center of the work path 112. This decreases the air flow from a higher value adjacent the wall 106 to a lower value adjacent the center of article 30 with this overall air flow indicated by arrows 116 thus forming a portion of an envelope, indicated at 114 in FIG. 4, of virtually still or quiescent air around the article 30. The higher air flow through the orifice plate 104 adjacent to the common front wall 106 prevents any back spray from the spray chamber toward the operators 24 or 32. The same decreasing velocity profile could have been obtained by using larger diameter orifices adjacent the outer edge 108 and smaller diameter orifices 106 adjacent to the inner edge 110.

As shown by the air flow arrows 124 in FIGS. 4 and 5, a portion of the air travelling up the rear vertical distribution ducts 78 is passed into rear plenum chambers 122 servicing the rear portion of the front spray chamber 42 and the rear portion of the rear spray chamber 48. The air passes through the orifice plates 104 as indicated by the air flow arrows 126 with the lower velocity adjacent the center 112 of the articles 30, increasing in velocity toward the rear walls 128 of the front and rear spray chambers 42 and 48. This air flow completes the envelope 114 of air surrounding the articles 30.

Another portion of the air, indicated by air flow arrows 142, passes from the rear vertical distribution ducts 78 to the slot nozzle conduits 130 located between the rear plenum chambers 122 and the back walls 128 of the spray chambers 42 and 48. Referring to FIG. 6, the slot nozzle conduit 130 includes a damper plate 132 which is attached to the top wall of the spray chamber by a longitudinally extending hinge 134. The free end of the damper plate 132 is curved into a downwardly extending flange 136. The damper plate can be pivoted about the hinge 134 by adjustment mechanism 138 to control the width of the slot nozzle 140 formed between the flange 136 and the back wall 128 of the spray chamber. The air flow out of the slot nozzle 140, indicated by the arrow 144, sweeps against the back wall 128 of the spray chamber to prevent any coating of the back wall. As seen in FIG. 10, the flange 136 is preferably formed with a sinusoidally shaped free end 152. This continuously varies the air delivery point of the slot nozzle 140 along its longitudinal extent, distributing flow and producing a much quieter high velocity air flow.

The operator compartment air flow 92 introduced through louvers 96 into the operator compartment and flowing into the spray chamber through window opening 154 combines with the air flow 116 from forward plenum 100 and air flow 126 from rear plenum 122 and passes downwardly into extraction hopper 148 as indicated by arrows 146 with air flow 144 traveling against the back wall 128 from slot nozzle 140 along with entrained coating powder particles not adhering to the articles 30. The walls of extraction hopper 148 converge downwardly to exhaust ducts 150 connected to the cartridge filter 62 for removal of the powder particles into bin 152 and return of clean air through intake duct 60 to the exhaust fan 58.

The structure and operation of the front spray chamber 42 and its associated operator compartment 14 is essentially the same as the structure and operation of the rear spray chamber 48 and its associated operator compartment 16. Hence, as can be seen by comparing FIGS. 4 and 5 depicting respectively the front and rear chambers and compartments, the same numerals were used for the respective front and rear air plenums 100 and 122 and the other elements including the indicated air flows. With the longer front spray chamber 42 and operator compartment 14, air is introduced through front and rear vertical distribution ducts 76 and 78 to both ends of the front and rear top air plenums 100 and 122 and to both ends of the operator compartment air supply duct 94 and the slot nozzle air supply duct 130. With the shorter rear spray chamber 48 and operator compartment 16, air is introduced to these four points at only one end.

It will be apparent from the foregoing discussion that while a powder coating booth having a two man operator compartment on one side of a spray chamber and a one man operator compartment on the other side of a spray chamber has been illustrated, that various combinations of this recirculating system are envisioned within the concepts of this invention. Considering the basic module of an operator compartment on one side of a spray chamber, an exemplary initial setup will be considered.

This example will refer to the front operator booth 14, front spray chamber 42, module shown in FIGS. 2 and 4 with the air flow pattern being illustrated in the foreground of FIG. 3. Keeping in mind that the overall envelope of the article 30 being sprayed will dictate to a degree the air flow settings of the five distribution points shown, which include the initial venting and proportioning to the four overhead air delivery points, the article 30 shown entering the powder coating booth 10 illustrated in FIG. 2 has been selected to be steel cabinet having a $6' \times 3' \times 2'$ dimension. The adjustable louver 68 in the distribution plenum chamber 66 has been set to vent 9% of the air being delivered by fan 58 to chamber 66. Thus 91% will be apportioned among the operator compartment air duct 94, the front plenum chamber 100, the rear plenum chamber 122 and the slot nozzle duct 130.

Air flows 116 and 126 through the orifice plates 104 of the front and rear plenum chambers 100 and 122 will be set equal to provide the envelope 114 surrounding the article 30. By experience the air flow 144 requirement through slot nozzle 140 to scour the back wall 128 will be higher than the air flow delivery 92 requirement through louver 96 to and through the operator compartment 14. To accomodate this, 47% of the total air should be delivered through the rear vertical distribution ducts 78, and 44% of the total air should be delivered through the front vertical distribution ducts 76. Accordingly, the dampers 80 and 82 in ducts 76 and 78 will be adjusted to accomplish this split.

It has been found that the air requirements through the orifice plate 104 are approximately one third the air requirements through the slot nozzle 140 or the operator compartment louvers 96. The individual dampers 88, see FIGS. 8 and 9, at the top of the front and rear ducts 76 and 78 were adjusted to produce equal air flows 116 and 126 through the orifice plates 104 for the front and rear plenums 100 and 122 of approximately 12%. This produces a 32% air flow 92 through louvers 96 to and through the operator compartment 14 and a 35% air flow 144 against back wall 128 from slot nozzle 140. In terms of actual air flows, this equates to approximately 475 cfm through each of the orifice plates, 1400 cfm through the slot nozzle, and 1310 cfm through the operator compartment louvers.

The air velocity downward over the article 30 will increase from a low value at the article or work path center 112, which can be of the order of 10–50 fpm traveling through the top conveyor opening 70 and the inner, more widely spaced, orifices 120, to approximately 80 fpm at the front and rear sides of the article 30 to maintain the quiescent air envelope 114, optimizing coating particle transfer to the article 30. Air velocity increases through the more densely spaced orifices 120 toward the back wall 128 and the front wall 106. The air velocity adjacent the outer edge 108 of the orifice plate 104 closest to the back wall 128 can be of the order of 300–400 fpm. A maximum air velocity is of the air 144 passing through the slot nozzle 140 which can be of the order of 1000–1500 fpm.

While the actual air flows and velocities may not be measured in set up, but rather the damper settings may be determined by results achieved, the above values were measured in test environments to give the skilled artisan a "feel" for the adjustments.

The operation and structure of the cartridge filter 62 has not been included as filters of this type are well known in the art.

Another feature of the present invention is the use of clear or transparent plastic for the orifice plates 104 and the provision of clear roof panels 156 so that light can be provided to the spray chambers from stationary light fixtures 158 outside of the spray booth 10 adjacent to the conveyer system 34.

I claim:

1. A powder coating booth in which electrically charged coating particles are sprayed onto articles being conveyed through the booth, comprising in combination:

a longitudinally extending spray chamber having front, back, top and bottom walls and ends through which the articles to be sprayed with coating particles are passed along a work path between said front and back walls;

a recirculating air blower passing air downwardly through orifices in said top wall on both sides of said work path, and passing air downwardly through a longitudinally extending slot nozzle in said top wall to sweep against said back wall;

an operator compartment having a common front wall with said spray chamber and also having back, top, bottom and end walls, said front wall having a window opening through which an operator sprays coating particles onto the articles passing along said work path;

means for providing a lower air flow through a central zone encompassing the work path than both the air flow through a front zone between said central zone and said front wall and through a rear zone between said central zone and said back wall by sizing and spacing said orifices in said top wall, wherein the air flow through the central zone, front zone and rear zone produces a quiescent air envelope around the articles to be sprayed along said work path, thus maximizing transfer of coating particles to the articles being sprayed and, prevents any back spray from the spray chamber toward the operator compartment;

said recirculating air blower passing air into said operator compartment through louvers in the top wall of said operator compartment adjacent the back wall of said operator compartment so that said air sweeps downwardly into said spray chamber through said window opening;

an extraction hopper in the bottom wall of said spray chamber for collecting air passing through the top wall of said spray chamber and through said window opening along with coating particles not adhering to said articles;

a filter receiving the air from said extraction hopper and removing the coating particles to produce clean air; and means passing the clean air from said cartridge filter to said recirculating air blower.

2. The powder coating booth according to claim 1 wherein a high efficiency filter is located between said recirculating blower and said louvers to further filter the air passing through said operator compartment.

3. The powder coating booth according to claim 1 wherein said powder coating booth is mounted on a mobile base so that said booth can be moved into and out of alignment with a conveyor line conveying articles to be sprayed through said booth.

4. The powder coating booth according to claim 1 wherein said longitudinally extending slot nozzle includes a damper plate hinged at one longitudinally extending side of said damper plate to said top wall and curved at a free longitudinally extending side opposite to said hinged side with means for moving said free side toward and away from said back wall to control the width of said slot nozzle.

5. The powder coating booth according to claim 4 wherein said damper plate curves into a downwardly extending portion at said free longitudinally extending side and said downwardly extending portion has a longitudinally extending sinusoidally shaped free end.

6. The powder coating booth according to claim 1 wherein a top air plenum is located on each side of said work path and said orifices are located in a downwardly facing orifice plate of each top air plenum.

7. The powder coating booth according to claim 6 wherein said recirculating air blower is connected to a distribution chamber below the bottom wall of said operator compartment, and said distribution chamber is connected with said top air plenums, with a duct supplying air through said longitudinally extending slot nozzle, and with a duct supplying air through said louvers into said operator compartment.

8. The powder coating booth according to claim 7 wherein means is provided for proportioning the amount of air supplied from said distribution chamber among each of said top air plenums, the duct supplying air through said longitudinally extending slot nozzle and the duct supplying air through said louvers.

9. The powder coating booth according to claim 7 wherein means is provided for venting a portion of the air supplied to said distribution plenum to atmosphere.

10. The powder coating booth according to claim 1 wherein said extraction hopper converges downwardly from said front wall of said spray chamber and towards said rear wall of said spray chamber to an exhaust duct connected to said filter.

11. The powder coating booth according to claim 10 wherein said operator compartment is of sufficient length to accommodate two operators spraying coating particles onto articles passing along said work path.

12. The powder coating booth according to claim 11 wherein the bottom wall of said operator compartment is divided longitudinally into two floors of different heights, assisting the operators in spraying the articles at two different levels.

13. The powder coating booth according to claim 12 wherein there is a separate extraction hopper and exhaust duct in the bottom wall of said spray chamber aligned with the two different floor heights of the operator compartment.

14. The powder coating booth according to claim 10 wherein said longitudinally extending spray chamber and said operator compartment comprise:

a first spray chamber and a first operator compartment having their common wall on a first side of said work path for spraying a front portion of said articles; and further including:

a second spray chamber on a second side of said work path having front, back, top and bottom walls and ends through which the articles to be sprayed with coating particles are passed along said work path between the front and back walls of said second chamber, one of the ends of said second spray chamber being contiguous with one of the ends of said first spray chamber;

a second operator compartment having a common front wall with said second spray chamber located on said second side of said work path, said second operator compartment also having a back top and end walls with said common front wall having a second window opening through which an operator sprays coating particles on a rear portion of said articles passing along said work path;

said recirculating air blower passing air downwardly into said second spray chamber through orifices in the top wall of said second spray chamber on both sides of said work path, passing air downwardly through a longitudinally extending slot nozzle in the top wall of said second spray chamber to sweep against the back wall of said second chamber, and passing air into said second operator compartment through louvers in the top wall of said second operator compartment adjacent the back wall of said second operator compartment so that the air sweeps downwardly into said second spray chamber through said second window opening; and a second extraction hopper in the bottom wall of said second spray chamber for collecting air passing through the top wall of said second spray chamber and through said second window opening along with coating particles not adhering to said articles; and said filter receiving the air from said second extraction hopper.

15. The powder coating booth according to claim 14 wherein said second extraction hopper converges downwardly from said rear wall of said second spray chamber and towards said front wall of said second spray chamber to an exhaust duct connected to said filter.

16. The powder coating booth according to claim 14 wherein said first operator compartment is of sufficient length to accomodate two operators spraying coating particles on the front portion of said articles at different levels.

* * * * *

UNITED STATES PATENT AND TRADEMARK OFFICE

CERTIFICATE OF CORRECTION

PATENT NO. : 5,397,394
DATED : March 14, 1995
INVENTOR(S) : Jerome D. Orr

It is certified that error appears in the above-indentified patent and that said Letters Patent is hereby corrected as shown below:

On the title page item [73], "The Fishing Group" should be --The Finishing Group--.

Column 5, line 4, delete "from" and insert --front--.

Column 5, line 19, delete "from" and insert --front--.

Column 5, line 20, after "booth" delete the period.

Column 5, line 27, delete "from" and insert --front--.

Column 10, claim 14, line 6, after "back" insert a comma.

Signed and Sealed this

Twenty-eighth Day of May, 1996

Bruce Lehman

*Attest:*

BRUCE LEHMAN

*Attesting Officer*

*Commissioner of Patents and Trademarks*